US006739942B2

(12) United States Patent
Tian et al.

(10) Patent No.: US 6,739,942 B2
(45) Date of Patent: May 25, 2004

(54) ULTRASONIC REMOTE AEROPLANE FOR AIR-BATTLE GAME

(76) Inventors: Yu Tian, 6D, Building T1, No. 2601, Xie Tu Road, Shanghai (CN), 200030; Wenyan Jiang, 6D, Building T1, No. 2601, Xie Tu Road, Shanghai (CN), 200030

( * ) Notice: Subject to any disclaimer, the term of this patent is extended or adjusted under 35 U.S.C. 154(b) by 84 days.

(21) Appl. No.: 10/126,883

(22) Filed: Apr. 22, 2002

(65) Prior Publication Data

US 2003/0082991 A1 May 1, 2003

(30) Foreign Application Priority Data

Oct. 26, 2001 (CN) ..... 01254376 U

(51) Int. Cl.[7] ..... A63H 30/00
(52) U.S. Cl. ..... 446/454; 446/456; 446/57
(58) Field of Search ..... 446/454, 456, 446/473, 34–48, 57

(56) References Cited

U.S. PATENT DOCUMENTS 3,957,230 A * 5/1976 Boucher et al. ..... 244/53 R
4,443,014 A * 4/1984 Kovit et al. ..... 273/363
4,591,114 A * 5/1986 Block ..... 244/120
4,701,681 A * 10/1987 Koike ..... 318/16
6,609,945 B2 * 8/2003 Jimenez et al. ..... 446/454

* cited by examiner

*Primary Examiner*—Teresa Walberg
*Assistant Examiner*—Julie Brocketti
(74) *Attorney, Agent, or Firm*—Rabin & Berdo, P.C.

(57) ABSTRACT

An ultrasonic remote aeroplane for playing air-battle game includes a wing, a cockpit, a propeller, a tail pole, a fin, a rudder, a main remote circuit for receiving the propeller rotation controlling signal and rudder motion controlling signal carried high frequency carrier transmitted from a remote transmitter, and a driving system thereof. The remote aeroplane further includes an air-battle box including at least an ultrasonic transmitting tube, an ultrasonic receiving sensor, an attachment structure for fixing to the aeroplane, and a control circuit corresponding to them. The remote transmitter further transmits a high frequency carrier carrying a signal F3 for instructing the ultrasonic transmitting tube to transmit ultrasonic waves. The main remote circuit further includes a circuit for receiving the high frequency carrier carrying the signal F3 and separating out the signal F3.

6 Claims, 7 Drawing Sheets

ULTRASONIC REMOTE AEROPLANE FOR AIR-BATTLE GAME

FIELD OF THE INVENTION

The invention relates to a sport equipment or a toy, and more particularly, to an ultrasonic remote aeroplane using an ultrasonic wave as its "weapon" for an air battle game.

BACKGROUND OF THE RELATED ART

Nowadays, as shown in FIGS. 1, 2, 3 and 4, the remote aeroplane available from the market substantially includes a system comprising a remote-controlled aeroplane and a remote-controlling transmitter. The remote-controlled aeroplane consists of a wing 1, a cockpit 2, a propeller 4, a tail pole 5, a fin 6 and a rudder 7. In the cockpit 2, there is a main remote circuit 9 including a receiving antenna 91, a high frequency receiver 92, a speed regulator 93, a motor 94 and a rudder control 95, as shown in FIG. 4. On the other hand, with its appearance shown in FIG. 2, the remote-controlling transmitter 8 comprises a power switch 81, a horizontal deflection stick 82 to manage the rudder 7 for left turn or right turn flying control, a transmitting antenna 83, an elevating stick 84, a housing 85 and a handle 86, with an encoder 87 and a high frequency amplifier 88 as its main parts within it (FIG. 3).

Once the power supply switch 81 is turned on, and the transmitting antenna 83 is drawn out, the remote-controlling transmitter 8 will be in an operating and controlling mode to transmit a signal to the aeroplane. When the elevating stick 84 is pushed upwardly, the signal will be coded by encoder 87, and a high frequency signal F1 will be transmitted by the high frequency amplifier 88 and transmitting antenna 83 to the air such that it is received by the aeroplane through antenna 91 thereof, and then amplified and decoded by the high frequency receiver 92 to obtain the signal F1 and sent to the speed regulator 93 for driving the motor 94 so as to start the propeller 4 to propell the plane up to the sky.

During the aeroplane flying, if the horizontal deflection stick 82 is set to the left or right side, a signal is then coded by encoder 87, and a high frequency signal F2 is transmitted by the high frequency amplifier 88 and transmitting antenna 83 to the air such that it is received by the aeroplane through antenna 91 thereof, and then amplified and decoded by the high frequency receiver 92 to obtain the signal F2 and sent to the rudder control 95 for controlling the rudder 7 to shift the route of the flying plane to the left or right side.

By the prior art described above, the remote aeroplane can be flying arbitrarily under the management of a player.

However, in the market today, there aren't any remote aeroplanes or model aeroplanes capable of practically playing air-battle games. Although it has been contemplated that the air battle of a remote aeroplane will be performed by using an infrared ray, it can find no way out on the sunny sky since it is hard to distinguish between an infrared ray and other sunlight rays in the daytime, and such a remote aeroplane is difficult to realize.

SUMMARY OF THE INVENTION

The invention is contemplated to solve the problems mentioned above by finding a "weapon" for air battle, and intended to provide a remote aeroplane capable of fighting air battle in daytime and night to raise more interest in remote aeroplane play and improve the health of players.

It is the concept of the invention that on the basis of original remote aeroplane, and ultrasonic remote aeroplane for playing air-battle game is implemented by using the ultrasonic beam as a "weapon" of air battle with an additional simple-circuit taken advantage of the existing radio remote techniques.

Thus, more particularly, the solutions of an ultrasonic remote aeroplane for playing air battle game according to the present utility are as follows:

An ultrasonic remote aeroplane for playing air-battle game comprising a wing, a cockpit, a propeller, a tail pole, a fin, a rudder, a main remote circuit for receiving the propeller rotation controlling signal and rudder motion controlling signal carried high frequency carrier transmitted from a remote transmitter, and a driving system thereof, wherein said remote aeroplane is characterized in that:

1) further comprises an air-battle box including at least an ultrasonic transmitting tube, an ultrasonic receiving sensor, an attachment structure for fixing to the aeroplane, and a control circuit corresponding to them;
2) said remote transmitter further transmits a high frequency carrier carrying a signal F3 for instructing said ultrasonic transmitting tube to transmit ultrasonic wave; and
3) said main remote circuit further comprises a circuit for receiving the high frequency carrier carrying the signal F3 and separating out the signal F3;

Wherein said air-battle box is arranged to have an ultrasonic transmitting tube, a buzzer, a control circuit board, and an ultrasonic receiving sensor sequentially located within a tubular housing, and an echo cover is disposed at the lower side of said housing toward the position of said buzzer, a fin is disposed at the middle of the tail end of said housing, a spring clip is disposed at the middle of the upper side of said housing with two brackets located respectively at both ends on the same side, and said control circuit board has control lines connected to a plug;

An inlet is disposed at the bottom with a socket located on one side in said cockpit so that the air-battle box is hanged securely under said cockpit by inserting the spring clip thereof into the inlet and supporting with the brackets, and the control circuit board can communicate with the main remote circuit in the cockpit electrically when the plug of the control line is inserted into the socket;

And wherein the control circuit board mainly comprises:

1) An amplifier circuit for amplifying the attack signal detected by the ultrasonic receiving sensor, an S seconds timer, a driving circuit to drive the buzzer for buzzing continuously and drive the speed regulator in the main remote circuit to turn off for a period of S seconds, and
2) A circuit for sending the signal F3 included in the signal F3 carried high frequency carrier received and separated by the antenna and the high frequency amplifier in the main remote circuit to the driving circuit in the control circuit board to initiate the ultrasonic transmitting tube for transmitting ultrasonic wave immediately and drive the buzzer for buzzing intermittently;

Wherein the operation range of said S seconds timer is from 5 seconds to 50 seconds, and a timing unit of said S seconds timer is 10 seconds.

DESCRIPTION OF PREFERRED EMBODIMENTS

Figure 1:
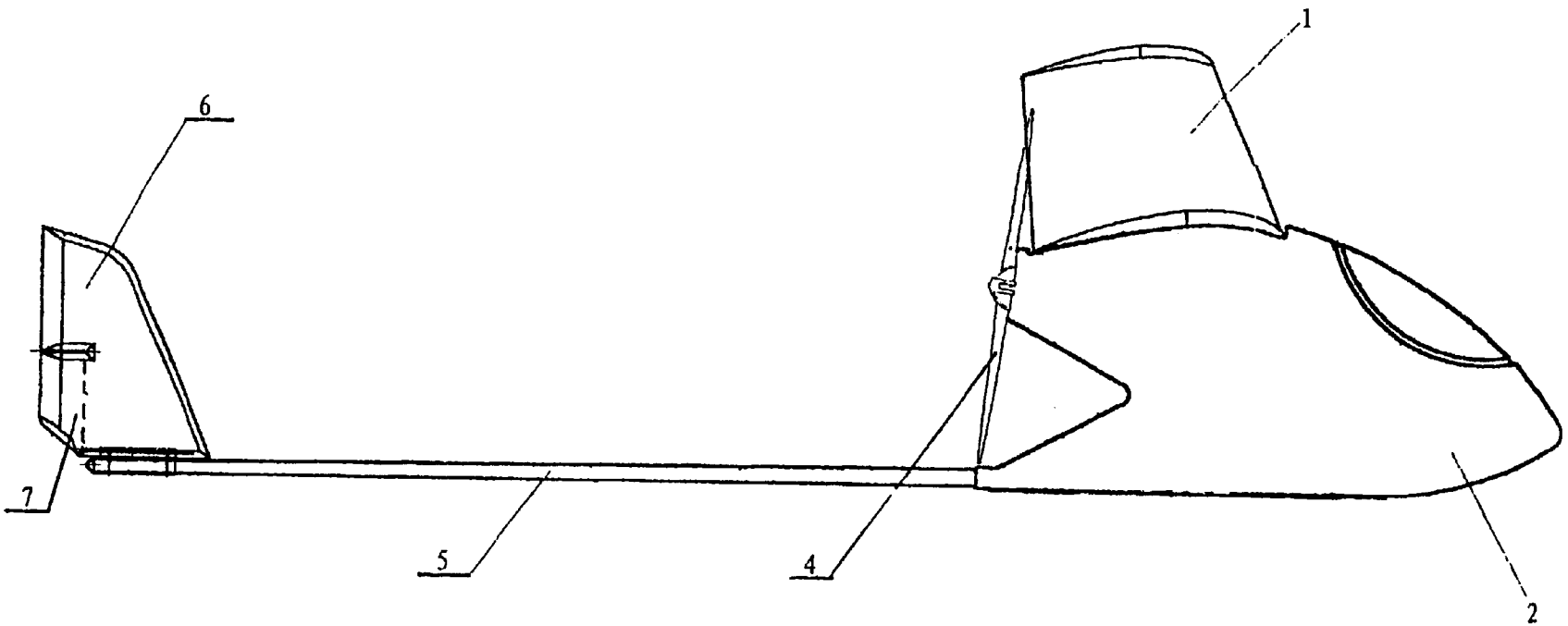
Fig. 1 PRIOR ART
FIG. 1 is a schematic view showing the structure of a remote aeroplane in prior art.
Figure 2:
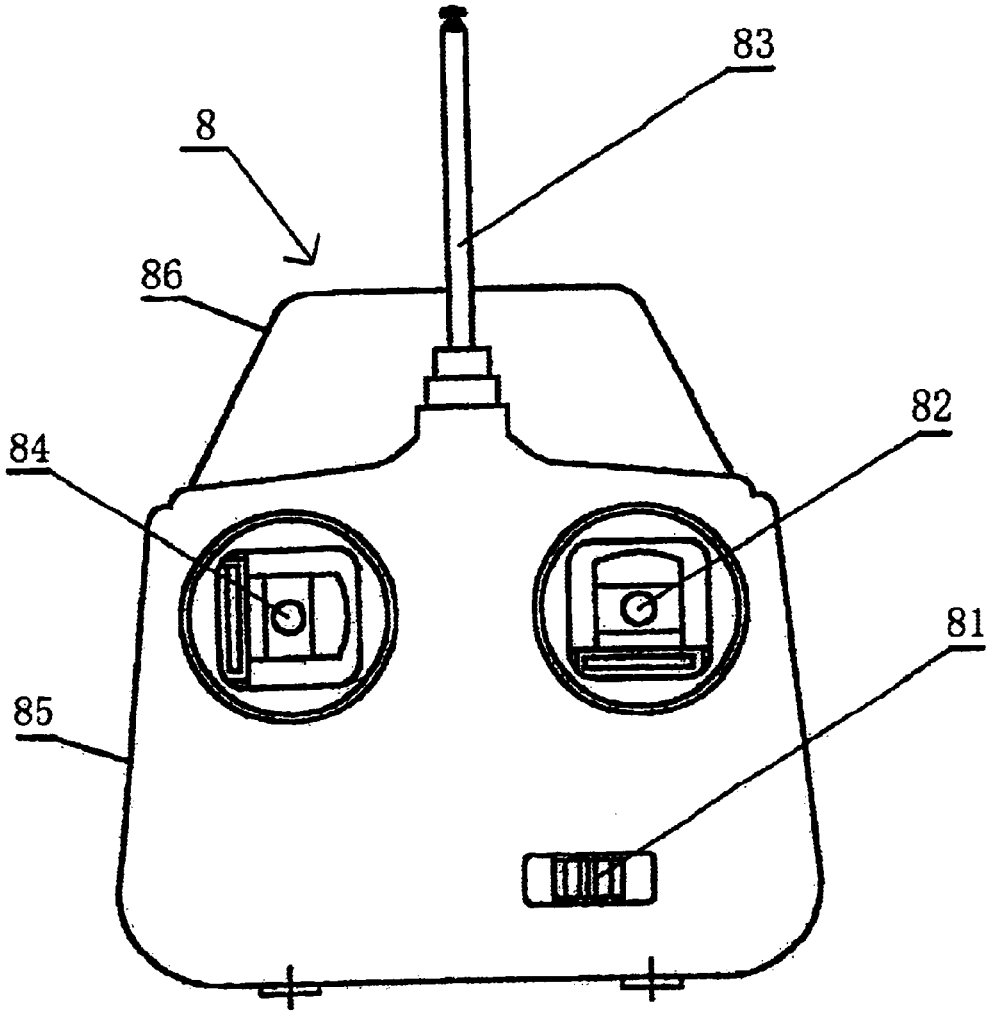
Fig. 2 PRIOR ART
FIG. 2 is a schematic view showing the exterior of a remote-controlling transmitter for the remote aeroplane in prior art.
Figure 3:
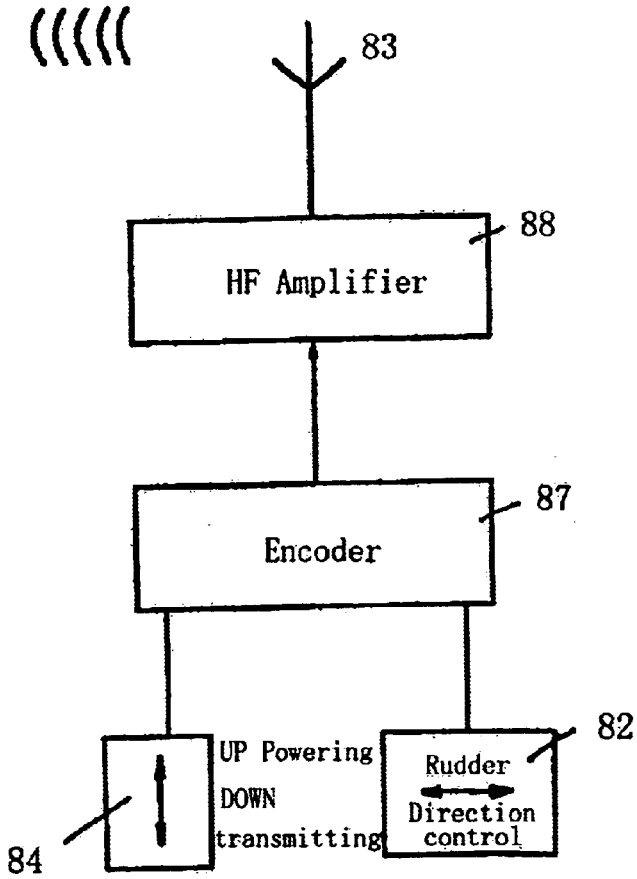
Fig. 3 PRIOR ART
FIG. 3 is a functional block diagram of the remote-controlling transmitter for the remote aeroplane in prior art.
Figure 4:
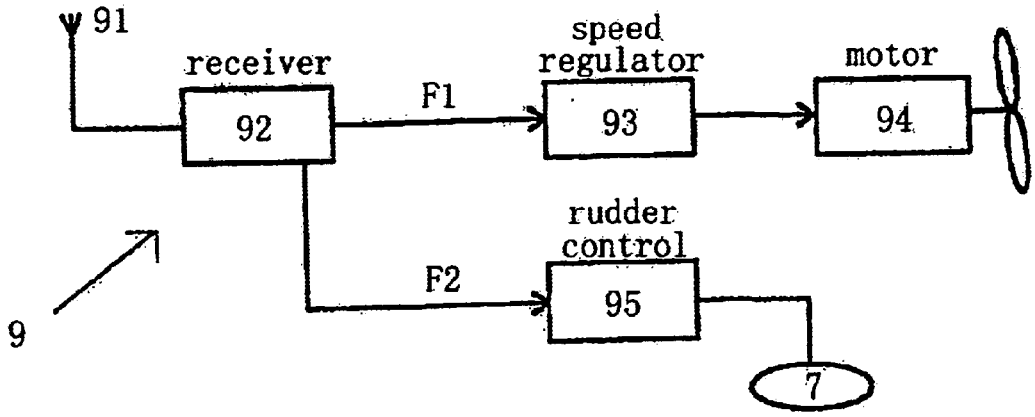
Fig. 4 PRIOR ART
FIG. 4 is a functional block diagram of a remote-controlled circuit in the cockpit of a remote aeroplane in prior art.
Figure 5:
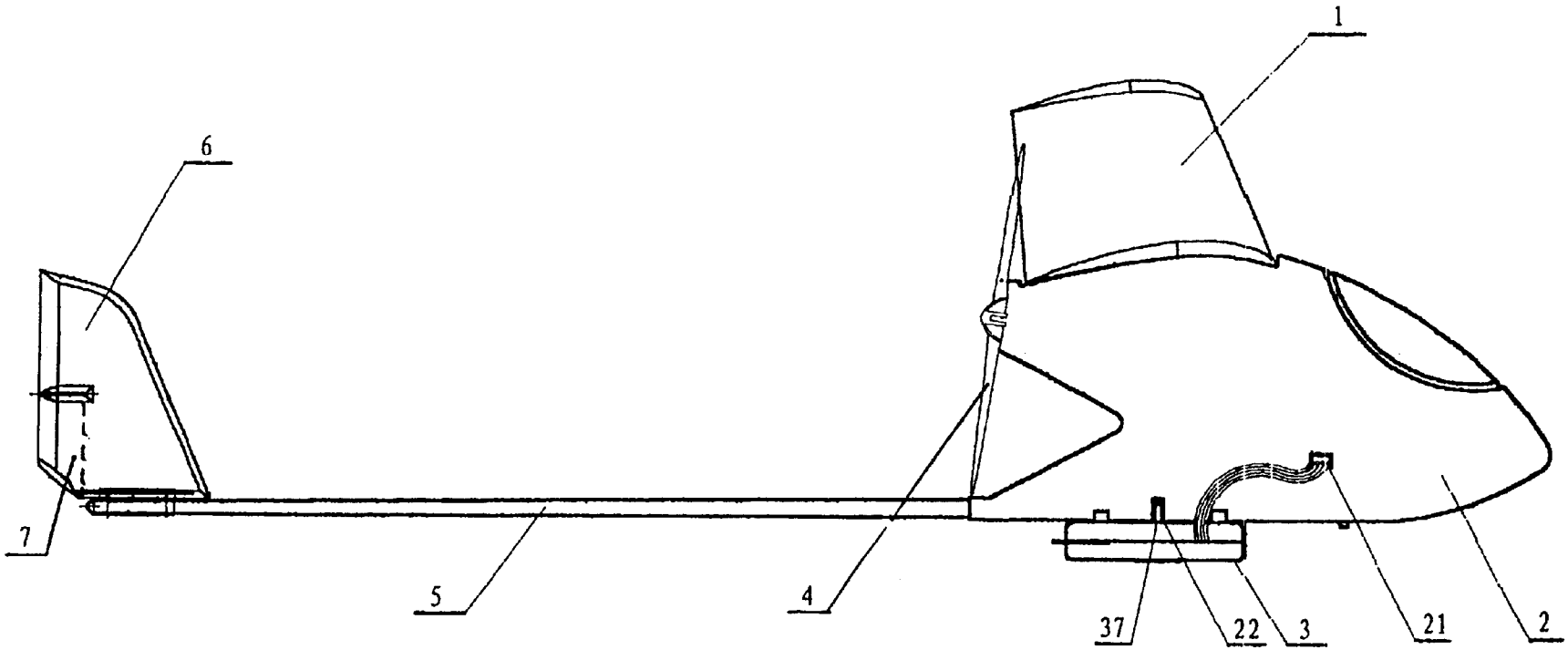
FIG. 5 is a schematic view showing the exterior structure of the ultrasonic remote aeroplane for air-battle game according to the invention.
Figure 6:
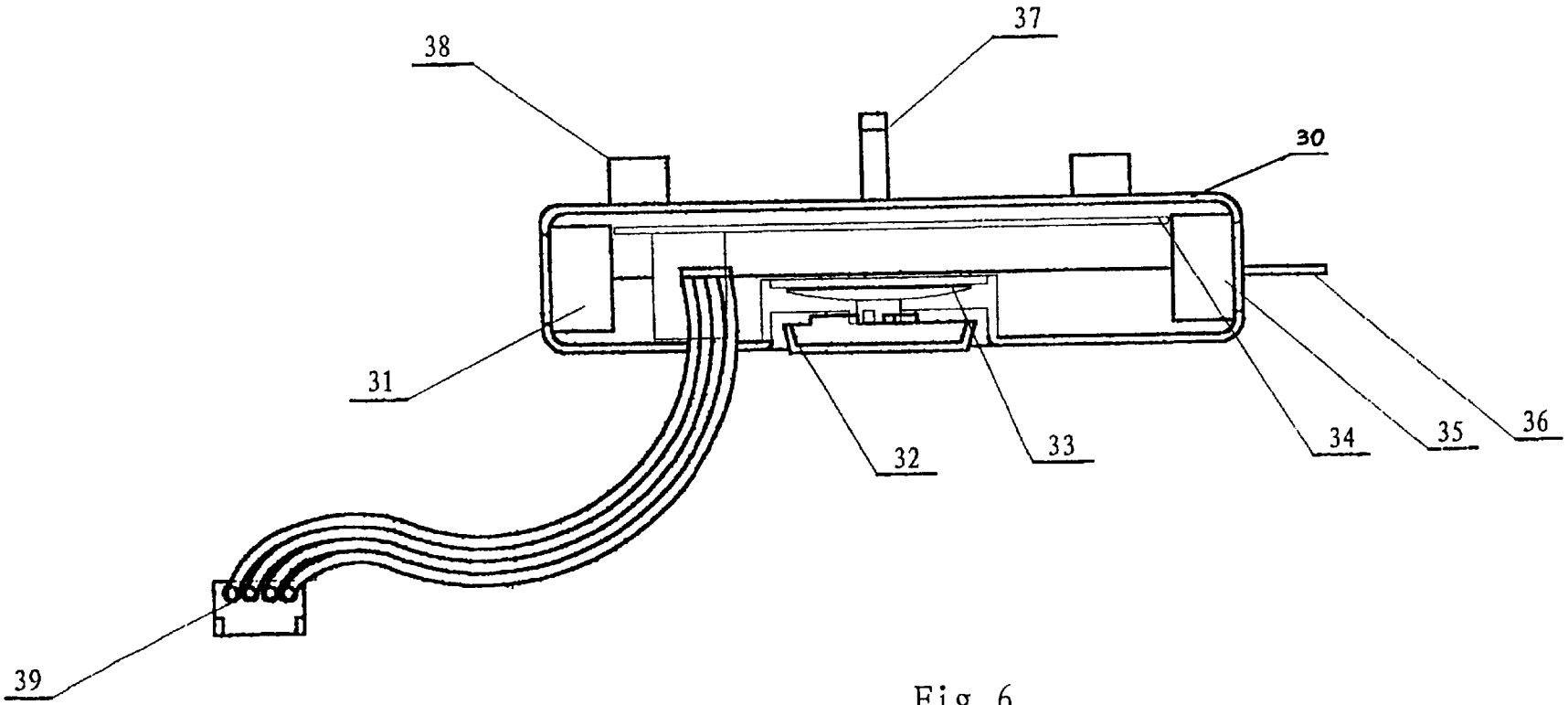
FIG. 6 is a schematic view showing the structure of an air-battle box in the ultrasonic remote aeroplane for air-battle game according to the invention.
Figure 7:
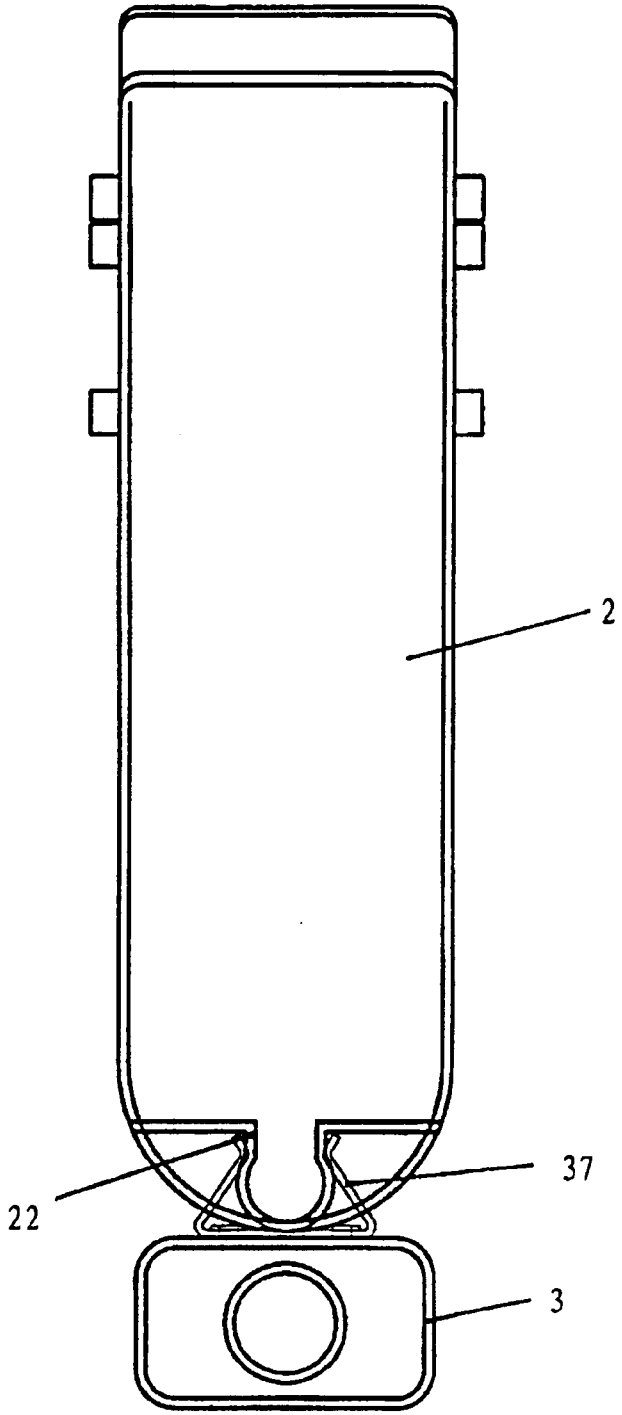
FIG. 7 is a schematic view illustrating the attachment of air-battle box to the cockpit.
Figure 8:
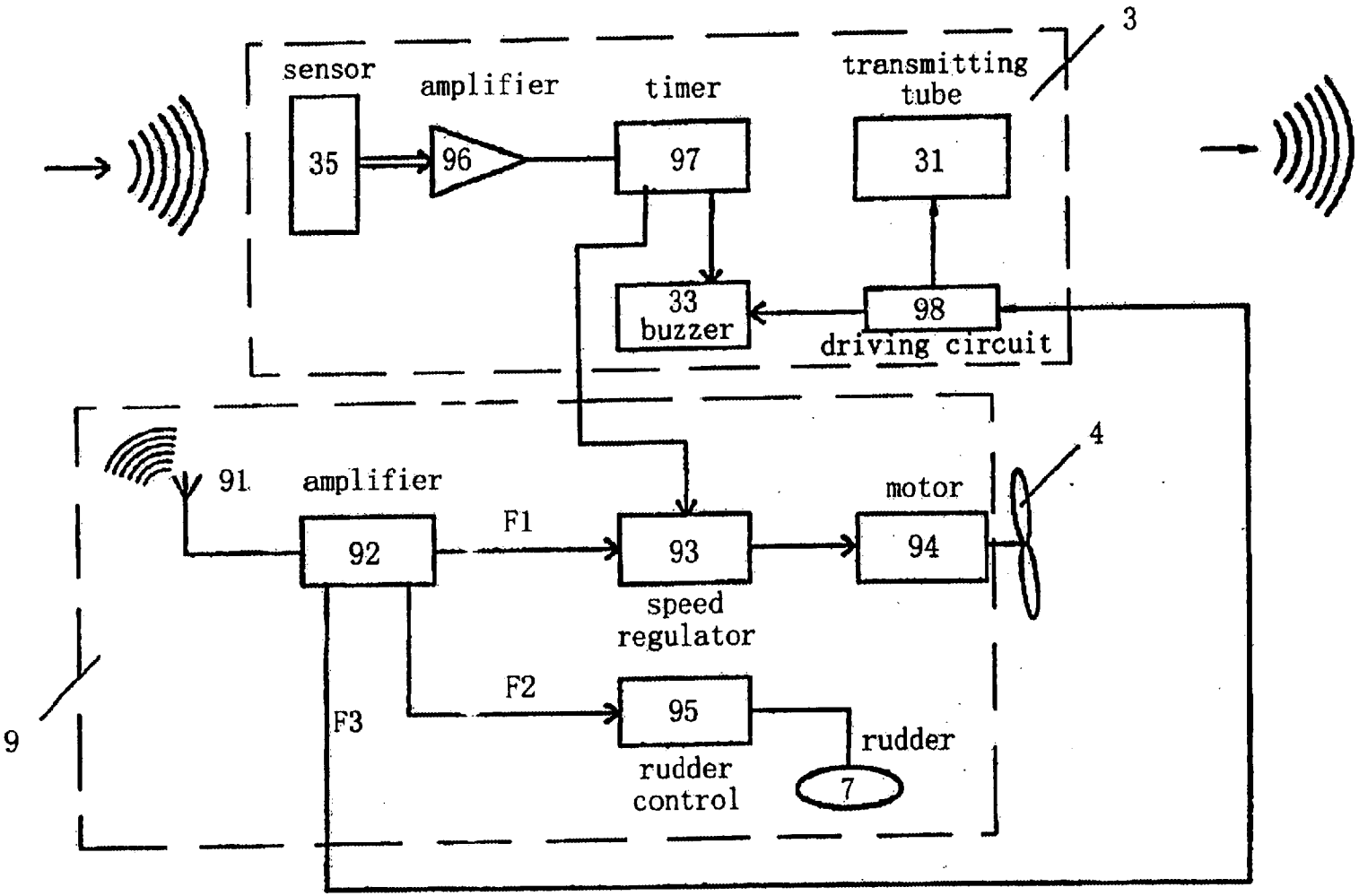
FIG. 8 is a block diagram showing the relation between remote circuit and air-battle box in the aeroplane according to the invention.

Any remote aeroplane can be configured to be an ultrasonic remote aeroplane for playing air-battle games by employing the particular air-battle box based on the concept according to this invention. FIG. 5 is a schematic view showing the exterior structure of the ultrasonic remote aeroplane (URA) for playing an air-battle game according to the present invention. Referring to this figure in conjunction with FIGS. 6, 7 and 8, a detailed description will be given below.

A URA according to the invention comprises a wing 1, a cockpit 2, a propeller 4, a tail pole 5, a fin 6, a rudder 7, and a main remote circuit 9 for receiving high frequency (HF) signal F1 capable of propeller 4 rotation control (propelling force control signal) and a high frequency signal F2 used to control the movement of rudder 7 (direction control signal) and a driving system for them. The features of the URA are as follows:

1. An ultrasonic beam is used as a "weapon" for air-battle.
2. An inlet 22 is provided at the bottom with a socket 21 located on one side in the cockpit 2.
3. The air-battle box 3 is arranged to have an ultrasonic transmitting tube 31, a buzzer 33, a control circuit board 34, and an ultrasonic receiving sensor 35 sequentially located within a tubular housing 30. An echo cover 32 is disposed at a lower side of the housing 30 toward the position of buzzer 33. A fin 36 is provided at the middle of the tail end of housing 30. A spring clip 37 is provided at the middle of the upper side of housing 30 with two brackets 38 located respectively at both ends on the same side. The control circuit board 34 has control lines connected to a plug 39.
4. The air-battle box 3 is hanged securely under the cockpit 2 by inserting the spring clip 39 into the inlet 22 and supporting with the brackets 38 to keep the normal flying attitude of the plane without disturbance, and the control circuit board 34 can communicate electrically with the main remote circuit 9 in the cockpit 2.
5. The control circuit board 34 mainly comprises:
   1) An amplifier circuit 96 for amplifying the attack signal detected by the ultrasonic receiving sensor 35, an S seconds timer 97, a driving circuit to drive the buzzer 33 for buzzing continuously as a representation of getting shot and to drive the speed regulator 93 in the main remote circuit 9 to turn off for S seconds such that the motor 94, and then the propeller 4, are stopped, and the plane falls, and
   2) A circuit for sending F3 high frequency signals received by the antenna 91 and HF amplifier 92 in the main remote circuit 9 to the control circuit board 34 to initiate the ultrasonic transmitting tube 31 for immediately transmitting ultrasonic waves and to drive the buzzer 33 for buzzing intermittently.
6. Although the main remote circuit 9 described above is basically similar to that in the prior art, the distinguished point thereof lies in that after the high frequency signals transmitted from the remote transmitter 8 have been received by the antenna 91 and amplified and decoded by the HF amplifier 92, the signals Fl (propelling force control signal), F2 (direction control signal), and F3 ("weapon" shooting signal) can be separated to start the propeller 4 through channel Fl, speed regulator 93 and motor 94 and to change the course through channel F2 and the rudder control and initiate the ultrasonic transmitting tube 31 to transmit ultrasonic wave waves through channel F3 and driving circuit 98, respectively.
7. An elevation stick 84 is added in the remote transmitter 8 described above for managing the antenna 83 to transmit the HF signal F3 when it is pulled down to a lower position.

Now, the air-battle process of two URAs operated and controlled by A and B parties, respectively, will be described below.

To enter the air-battle state, two URAs (referred to as planes A and B respectively) are flying and pursuing each other in the sky by remote control.

If plane A is flying in pursuit of plane B (or vice versa) and catches it within its attack range, then the player A will pull down the elevation stick 84 in his or her remote transmitter 8 to immediately transmit an ultrasonic HF signal F3 through antenna 83.

This HF attack signal F3 should be received by the plane A (must not be received by plane B) through its receiving antenna 91 and amplified and decoded by the HF amplifier 92 to initiate the ultrasonic transmitting tube 31 for transmitting ultrasonic waves ("shelling") and trigger the buzzer 33 for buzzing intermittently to show "shells shooting" at the same time via the channel F3.

If the "shells" from plane A are aimed at plane B, the ultrasonic wave should be received by the ultrasonic receiving sensor 35 at the tail end of air-battle box 3 in the plane B, and the signal outputted from the sensor 35 is amplified to operate the S seconds timer for driving the buzzer 33 for buzzing continuously to show "getting a shot" and turning off the speed regulator 93 to stop the motor 94 (also barring the initiation of the motor 94 from player B through the remote transmitter 8 thereof) and propeller 4 for S seconds, and thus the plane B will drop and fall.

After S seconds, the speed regulator 93 will be reset to turn-on, and the plane B will be operated by the control of player B through the remote transmitter 8 to continue the air-battle game with plane A if the plane B is still on the sky.

An attack from plane B to plane A also can be taken with the process similar to that described above.

As described above, the improved effects resulted from the invention are as follows:

1. The ultrasonic weapon is superior to the infrared weapon in that an "attack" can be functioned in a particular range whether in daytime or at night;
2. The air-battle box is compact and light in weight so as to hang under the cockpit stably without the distortion of normal fly attitude of the plane;
3. By applying the invention detailed described above, different types of remote aeroplanes can be adapted to be an air-battle plane with attacking power; and 4. A new type remote aeroplane is provided for model-aeroplane enthusiasts to enjoy the player with increased interests and promote the development of such healthy sport.

Although various embodiments of the invention have hereinbefore been disclosed and described, the invention is nonetheless limited only by the following claims.

We claim:

1. An ultrasonic remote airplane for playing an air-battle game, comprising:

a rudder and a propeller;

a main remote circuit means for receiving, amplifying and decoding a propeller rotation control signal and a rudder motion control signal, which are transmitted at a high frequency from a remote transmitter to respectively cause the propeller to rotate and the rudder to move, and for receiving a high frequency attack signal transmitted by the remote transmitter and separating out the attack signal from the propeller rotation control signal and the rudder motion control signal; and an air-battle box including at least an ultrasonic transmitting tube that transmits ultrasonic waves when said main remote circuit means receives the attack signal, a buzzer, an ultrasonic receiving sensor adapted to receive ultrasonic waves emitted from a further ultrasonic remote airplane, an attachment means for fixing said air-battle box to the airplane, and a control circuit means for controlling the ultrasonic transmitting tube and the ultrasonic receiving sensor;

wherein when said ultrasonic transmitting tube transmits the ultrasonic waves, said buzzer is caused to intermittently buzz, to simulate a firing of a shot from said ultrasonic remote airplane;

wherein when said ultrasonic receiving sensor receives the ultrasonic waves emitted from the further ultrasonic remote airplane, said buzzer is caused to buzz continuously to indicate the airplane has been shot, and rotation of said propeller is stopped for a predetermined period of time, causing the airplane to fall; and wherein after the predetermined period of time has elapsed, the buzzer ceases buzzing, and the propeller resumes rotation, allowing the airplane to continue flying.

2. The remote airplane as set forth in claim 1, wherein said air-battle box further includes a tubular housing, an echo cover disposed at a side of said housing in a region of said buzzer, a fin disposed at a middle of a tail end of said housing, a spring clip disposed at a middle of an upper side of said housing, and two brackets located on a same side of said housing and at opposite ends thereof, said control circuit means including a control line connected to a plug, wherein said ultrasonic transmitting tube, said buzzer, said control circuit means, and said ultrasonic receiving sensor are sequentially located within said tubular housing.

3. The remote airplane as set forth in claim 2, further comprising a cockpit having an inlet disposed at a bottom thereof, the inlet being adapted to receive the spring clip therein for hanging said air-battle box under said cockpit and securing thereto using said brackets, said cockpit further having a socket adapted to receive said plug to allow said control circuit means to communicate with said main remote circuit means; wherein said main remote circuit means is disposed within said cockpit.

4. The remote airplane as set forth in claim 3, wherein said control circuit means includes an amplifier circuit for amplifying the ultrasonic waves detected by the ultrasonic receiving sensor, a timer for timing the predetermined period of time, a driving circuit to drive the buzzer to buzz continuously and to turn off a speed regulator in said main remote circuit means to stop the rotation of said propeller; and further comprising a circuit for sending the attack signal to said driving circuit to initiate said ultrasonic transmitting tube for immediately transmitting the ultrasonic waves and to drive said buzzer to intermittently buzz.

5. The remote airplane as set forth in claim 4, wherein the predetermined period of time is between 5 seconds and 50 seconds.

6. The remote airplane as set forth in claim 5, wherein the predetermined period of time is 10 seconds.

* * * * *